US008365322B1

(12) United States Patent
Cox et al.

(10) Patent No.: US 8,365,322 B1
(45) Date of Patent: Feb. 5, 2013

(54) MULTI-POSITION REMOTE LATCHING MECHANISM

(76) Inventors: Randy Jay Cox, Filer, ID (US); Elizabeth Jeanne Cox, Filer, ID (US)

( * ) Notice: Subject to any disclaimer, the term of this patent is extended or adjusted under 35 U.S.C. 154(b) by 97 days.

(21) Appl. No.: 13/018,441

(22) Filed: Feb. 1, 2011

Related U.S. Application Data

(60) Provisional application No. 61/300,145, filed on Feb. 1, 2010.

(51) Int. Cl.
*A47C 17/13* (2006.01)

(52) U.S. Cl. ..... 5/18.1; 5/17; 5/55.1; 5/59.1

(58) Field of Classification Search ..... 5/12.1, 5/17, 18.1, 41, 55.1, 58, 59.1; 297/111, 118; 16/113.1
See application file for complete search history.

(56) References Cited

U.S. PATENT DOCUMENTS

| | | | | |
|---|---|---|---|---|
| 2,118,050 | A * | 5/1938 | Martin | 5/18.1 |
| 2,243,680 | A * | 5/1941 | Pink et al. | 5/18.1 |
| 3,005,997 | A | 10/1961 | Fox | |
| 3,113,325 | A | 12/1963 | Kamp | |
| 3,123,836 | A * | 3/1964 | Bendell | 5/17 |
| 3,138,804 | A | 6/1964 | Bendell | |
| 3,164,849 | A * | 1/1965 | Poskin | 5/41 |
| 3,767,258 | A | 10/1973 | Spence | |
| 4,586,206 | A * | 5/1986 | Singer | 5/18.1 |
| 4,953,245 | A | 9/1990 | Jung | |
| 5,460,441 | A | 10/1995 | Hastings et al. | |
| 5,908,218 | A | 6/1999 | Martin | |
| 5,988,749 | A | 11/1999 | Williams | |
| 6,463,603 | B1 * | 10/2002 | Camfield | 5/18.1 |
| 6,934,979 | B2 | 8/2005 | Swan | |
| 7,685,655 | B1 | 3/2010 | Delmestri | |
| 2007/0151393 | A1 | 7/2007 | Phillips, II et al. | |

OTHER PUBLICATIONS

Dictionary.com, "modular," in Dictionary.com Unabridged. Source location: Random House, Inc. http://dictionary.reference.com/browse/modular. Available: http://dictionary.reference.com. Accessed: Mar. 16, 2012.

Dictionary.com, "module," in Dictionary.com Unabridged. Source location: Random House, Inc. http://dictionary.reference.com/browse/module. Available: http://dictionary.reference.com. Accessed: Mar. 16, 2012.

* cited by examiner

*Primary Examiner* — Michael Trettel
(74) *Attorney, Agent, or Firm* — Jack M. Choules

(57) ABSTRACT

The patient room window seat converts between a bench seat and a bed with a simple pull of a handle. In the seat position part of a horizontal upholster cushion is under the backrest so the portion of the cushion in available is the correct width for comfortable seating. Moving the upholstered cushion forward until fully uncovered provides a comfortable bed. A second knob removes a stop allowing the cushion to fully extend and leave the base uncovered in a service position that gives full access for cleaning. The patient room seat is constructed with a commercially available heavy-duty ball bearing slides and a modular multi-position remote latching mechanism. The slides and the latching mechanism working in combination provide an effortless transition between the seat and bed position, allowing elderly or weakened individuals to operate the window seat without problem.

20 Claims, 4 Drawing Sheets

CLEANING/SERVICE

SEAT

BED

SAFETY

SEAT

SAFETY

BED

CLEANING/SERVICE

MULTI-POSITION REMOTE LATCHING MECHANISM

BACKGROUND OF AN EMBODIMENT OF THE INVENTION

An embodiment of the invention relates to a piece of furniture convertible between a bench seat and a bed, and particularly to the modular remote latching mechanism that latches the convertible piece of furniture in multiple positions including the seat position and the bed position. A remote latching mechanism as the term is used herein refers to a latching mechanism in which the latch is removed from the actuator part of the latch. The term modular as the term is used in reference to the latching mechanism means that there are discrete modules that are installed that work together to latch into each other. The remote latching modules are fastened into the furniture but do not otherwise interact with other furniture components. For example, a latching bolt or pin does not engage the framework of the furniture as it only engages another module of the latching mechanism. Therefore, the remote latching mechanism is mass-produced and fastened into furniture without further modification of the furniture.

There is a known demand for pieces of furniture, which provides a surface for people to sit on during the day, and a surface to sleep on at night; there have also been many solutions to this demand. Such solutions include; sleeper sofa, futons, and recliner chairs. There is also commercial demand for chairs, convertible to beds in locations where space is limited and at least occasionally, there is a need for sleeping facilities. This demand would be in commercial enterprises such as; motels and hotels, where such furniture could be used in place of roll-away beds to institutional centers such as nursing homes and hospitals, where such furniture would allow family members to stay overnight with patients.

In hospitals, it is more important for a piece of furniture designed to satisfy needs such as; sanitation, ease-of-use, durability and ease of maintenance and finally the furniture must be comfortable. It is an imperative that hospitals maintain a clean and sterile environment, therefore furniture is preferred that is made of easily cleaned materials and that allow full access to all parts for a thorough cleaning. It is desirable to secure parts of the furniture such as cushion avoiding contact with contaminated surfaces such as the floor. As it is important that the materials used in the fabrication of the cushions and the furniture as a whole, be resistant to liquid spills and other sources of contamination, and to the chemicals used to clean and disinfect. Further, it is important to seal all cracks and crevices to keep out liquids and other contaminants.

Easy operation of all latches and mechanisms needed to navigate from the seat position to the bed position is preferable. Advantageously the conversion between seat and bed should be operable by patients or visitors who may be elderly and or infirm and unable to operate stiff, heavy or complicated mechanisms. This would eliminate the need for calling a nurse or staff member to open the bed. It would be convenient to have storage for the bedding allocated within the bed itself making it readily available and save staff time in obtaining the bedding for the visitor.

Having durable, easily repairable furniture saves the hospital replacement costs, and in the case of the bench/bed keeps availability of sleeping overnight for visitors in each patient room of the hospital. Constructing the bench/bed from parts that are commercially available simplifies repairs and eliminates any need to replace or discard the original bed/bench.

There has been previous work to provide a convertible bench seat to bed for hospital work as disclosed in U.S. Pat. No. 6,934,979. The bench seat is made of materials easily sanitized for use in a hospital environment. However, the mattress is folded and stored in a drawer and must be lifted out, possibly a physically demanding procedure. The mattress may contact the floor or other non-sanitary surfaces in the process. In addition, the mattress is hinged down the length of the mattress causing a less comfortable area in the center of the mattress. U.S. Pat. No. 3,767,258 discloses a piece of furniture also designed to be convertible between a sitting position and a sleeping position. However, the multiple cushions are loose, leading to the problems of touching the floor and comfort issues previously mentioned.

Thus there is a need for a piece of hospital furniture which is convertible between a bench seat and a bed that is easily and safely operated, prevents the spread of contamination by being sealed and resistant to spills, provides full access to clean and maintain, and is made of material that have long life in the hospital environment.

SUMMARY OF AN EMBODIMENT OF THE INVENTION

An embodiment of the invention is directed to a remote latch mechanism that is modular in design and allows effortless actuation of the latch. The remote latch is made up of two modules working together to provide positive positional control of a moveable element relative to a fixed element. In a preferred embodiment, the fixed element is a cabinet base for a bench seat, and the movable element is an upholstered cushion mounted on a seat support frame, which rides on heavy-duty slides. The slides allow easy conversion from a seat position, in which part of the cushion is under a backrest, to a bed position, where the full cushion is exposed.

There are two latch assembly modules; the first module is an Upper Latch Housing (ULH) including the remote latch, a spring-loaded bolt on one end and the actuating handle on the other end. Pulling the handle moves a cable that retracts the bolt of the spring-loaded bolt, thus allowing the cushion platform to move horizontally between multiple positions. The ULH also includes a stop, to limit the movement of the seat support frame and prevent the cushion from moving past the bed position. A second module is the U-Shaped Track (UST), which includes a latch point flat bar which receives the spring-actuated bolt from the ULH to latch the bench seat in multiple discrete possible positions. The UST also includes a directly actuated spring-loaded bolt that when actuated, allows the assembly to pass the stop on the ULH and continue to the service position.

In the bed position, the full width of the cushion is made available as a single piece, flat mattress without seams, hinges, or multiple pieces of cushion abutting. This one-piece construction is more comfortable. If, for any reason the bolt does not enter the Latch flat bar hole corresponding to the bed position there is a safety position to prevent retraction of the cushion. By using a directly actuated spring-loaded bolt on the UST, at the bed position, the stop can be bypassed and the cushion can be fully extended to the service position. In the service position the complete base and cushion assembles are accessible for maintenance or thorough cleaning and sanitizing. The cushions may be upholstered with vinyl or other hospital grade material to protect the cushions from liquid spills or contamination.

The combination of the remote latch assembly and the heavy-duty slides make the conversion between bed and bench seat as easy as opening and closing a drawer.

DETAILED DESCRIPTION OF THE PREFERRED EMBODIMENTS OF THE INVENTION

Figure 1:
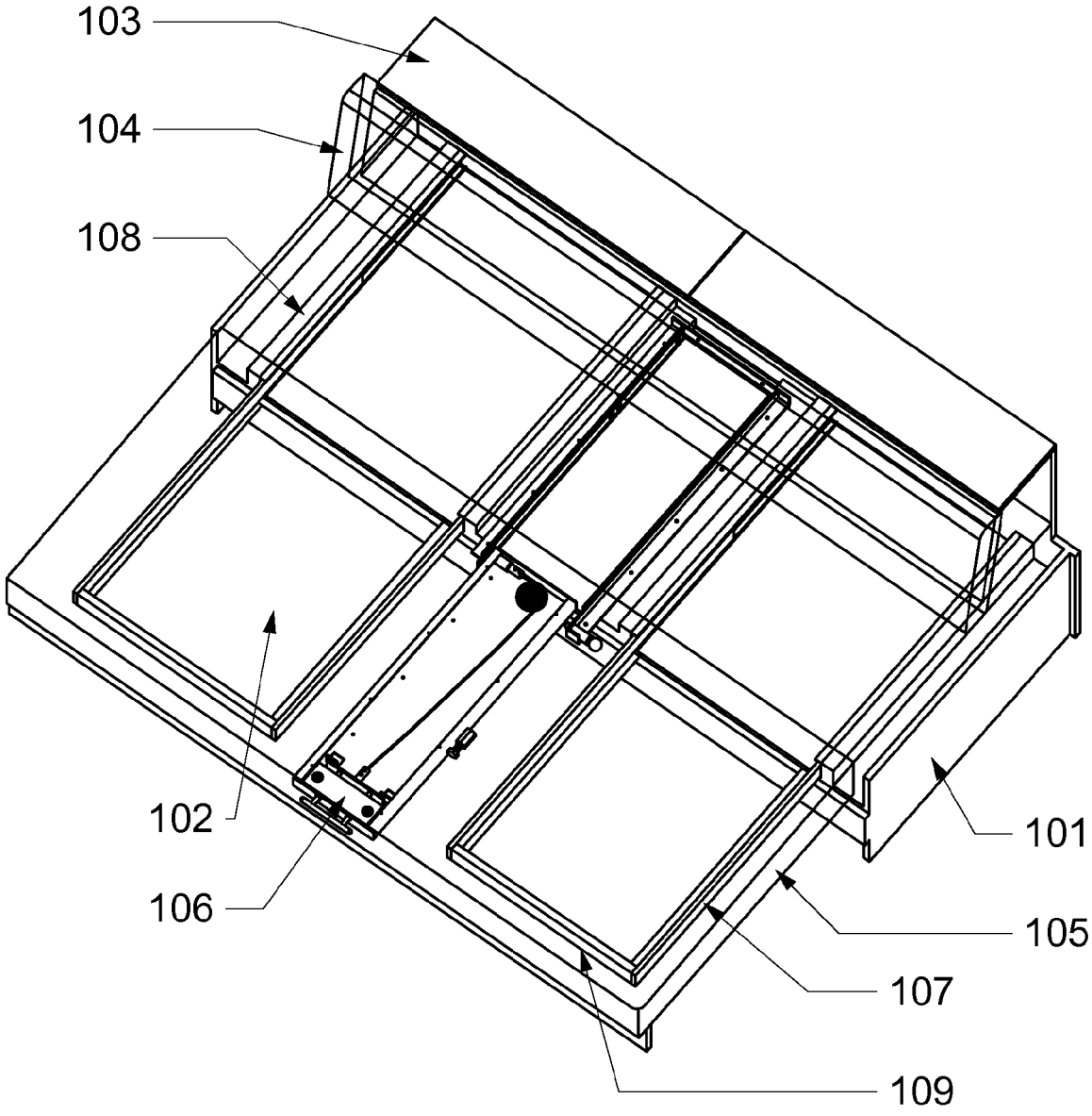
FIG. 1 is a top down view of an embodiment of the invention showing a bench seat convertible to a bed in the fully open or service position with the Multi-Position Remote Latch Mechanism (MPRLM) included.

A description of the preferred embodiment illustrated in the drawings is provided for the purpose of setting forth a preferred embodiment of the invention, and a best mode for its implementation. It will nevertheless be understood that, no limitation of the scope of the invention is intended by the description. It would be clear to one of skill in the art the invention relates to, that many modifications to the embodiment may be made.

Figure 2:
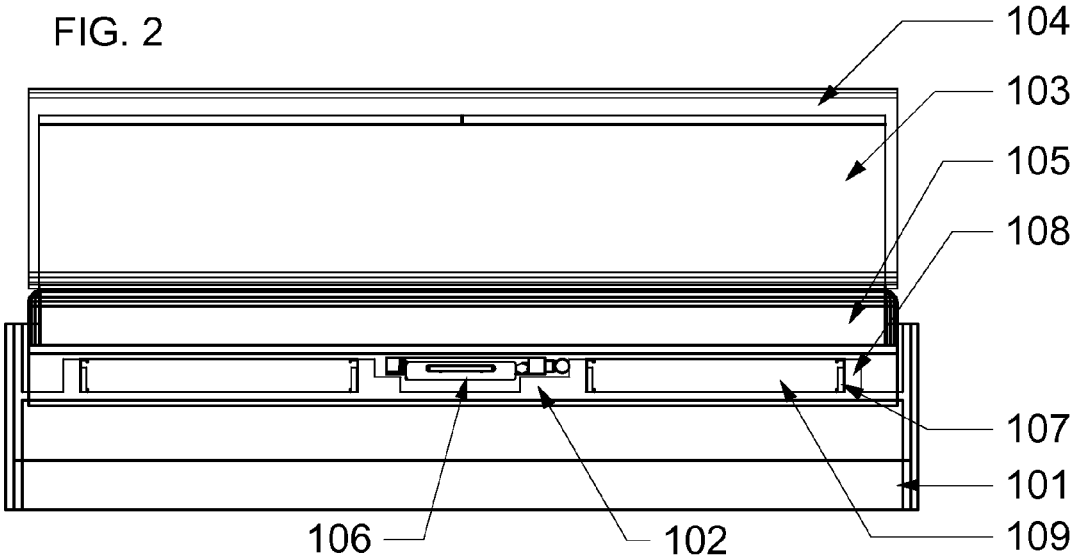
FIG. 2 is a front view of the embodiment of the invention.
Figure 3:
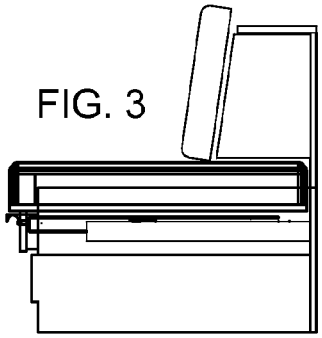
FIG. 3 is a side view of the embodiment of the invention in the seat position.

FIG. 1 shows a top view, FIG. 2 a front view, and FIG. 3 through six show side views of an embodiment of the invention, comprising a space-saving patient room window seat that is convertible into a bed, also referred to as a bench seat in this specification. The seat cushion 105 moves horizontally between a seat position, a bed position, and a fully open service position on slides 107. The base cabinet 101 provides the necessary foundation to support the weight of the assembled seat with the addition of the possibly substantial weight of multiple individuals who may be upon it in any of the seat, bed, or service positions. The base cabinet has a support structure that carries the specific load demands in a vertical alignment from the slides into vertically stacked petitions that extend through the base cabinet and rest upon the floor of the building structure. The base cabinet also provides a solid back-mounting panel, through which mechanical fasteners may be installed into the building wall studs, or supports for permanent stability of the bench seat. On top of the base framework are four slide mounding members 108 to which the slides are mounted. In the hospital environment, the base cabinet is preferably fully enclosed and caulked to seal out liquids and contaminants.

The cassette 102 is fastened on top of the base cabinet 101. The cassette 102 provides seamless extension of the seat cushion 105, horizontally through its range of movement to the various allowed positions. The cassette 102 includes the seat support frame 109, the slides 107, the seat cushion 105 and the multi-position remote latching mechanism (MPRLM) 106. The seat support frame 109 provides a framework, which solidly supports the seat cushion-mounting panel and is securely mounted to and supported by the seat slides 107. There are four slides 107 that are commercially available heavy-duty full extension ball bearings slides. The slides provide 1000-pound support capacity and are very smooth and effortless to operate. The seat cushion 105 is upholstered on top of the seat cushion panel with adequate cushioning, to provide a comfortable seat for multiple individuals, and provide a comfortable mattress in the bed position. Vent holes are machined into the seat cushion panel below the seat cushion 105 to allow air from the cushion to escape downward. The MPRLM 106 provides positive position control with multiple latching points as described herein below.

The backrest cabinet 104, may be mounted on structural members rising from the back of the base cabinet 101 or preferably, the backrest cabinet 104 may be mechanically attached to the building wall studs or supports. With either method, it is important that there is a gap sufficiently large for the cassette 102 with the cushion to pass under the back rest cabinet 104 in the seat position. The back rest cabinet 104 supports the back rest cushion 103 at an ergonomically correct angle. The back rest cushion 103 is an upholstered panel with adequate cushioning for supporting the back and shoulders of individuals seated on the patient window seat. The seat also provides a protective barrier against contact with the doors of the back rest cabinet 103. The backrest cabinet 103 also provides a versatile storage cabinet with lift-up lids on top to secure the stored contents such as pillows and bedding. The upholstery material of the seat cushion and back cushion may be any commercially available upholstery material; however, in a hospital setting vinyl or other spill proof, liquid resistant upholstery would be preferable.

Figure 6:
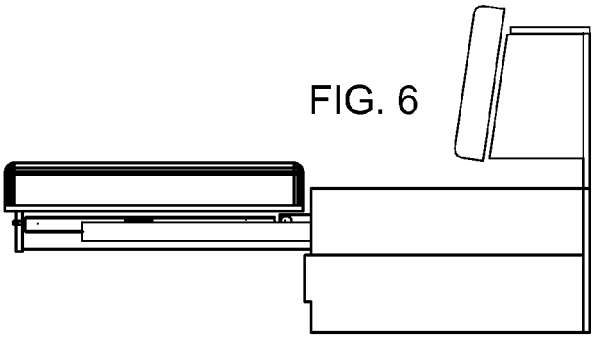
FIG. 6 is a side view of the embodiment of the invention in the service position.
Figure 5:
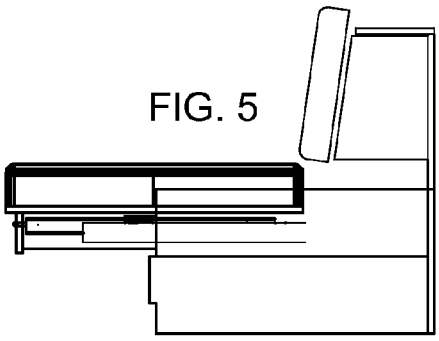
FIG. 5 is a side view of the embodiment of the invention in the bed position.
Figure 4:
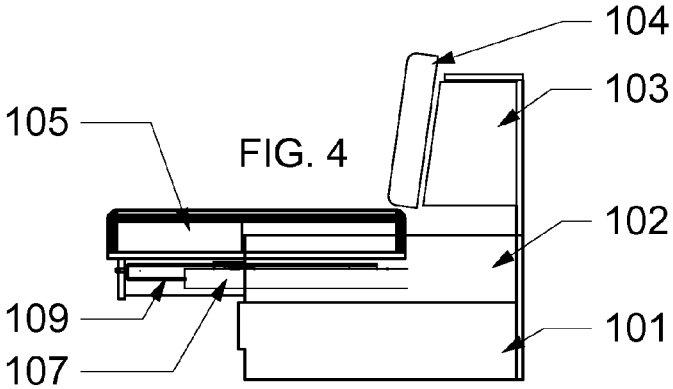
FIG. 4 is a side view of the embodiment of the invention in the safety position.

Side views FIGS. 3 through 6 show of the patient room window seat in its various operational positions. FIG. 3 shows the patient room window seat in the seat or bench position. FIG. 4 shows the patient room window seat in the safety position. FIG. 5 shows the patient window room seat in the bed position. FIG. 6 shows the patient room window seat in the fully extended or service position, allowing full access for cleaning or maintenance.

Figure 7:
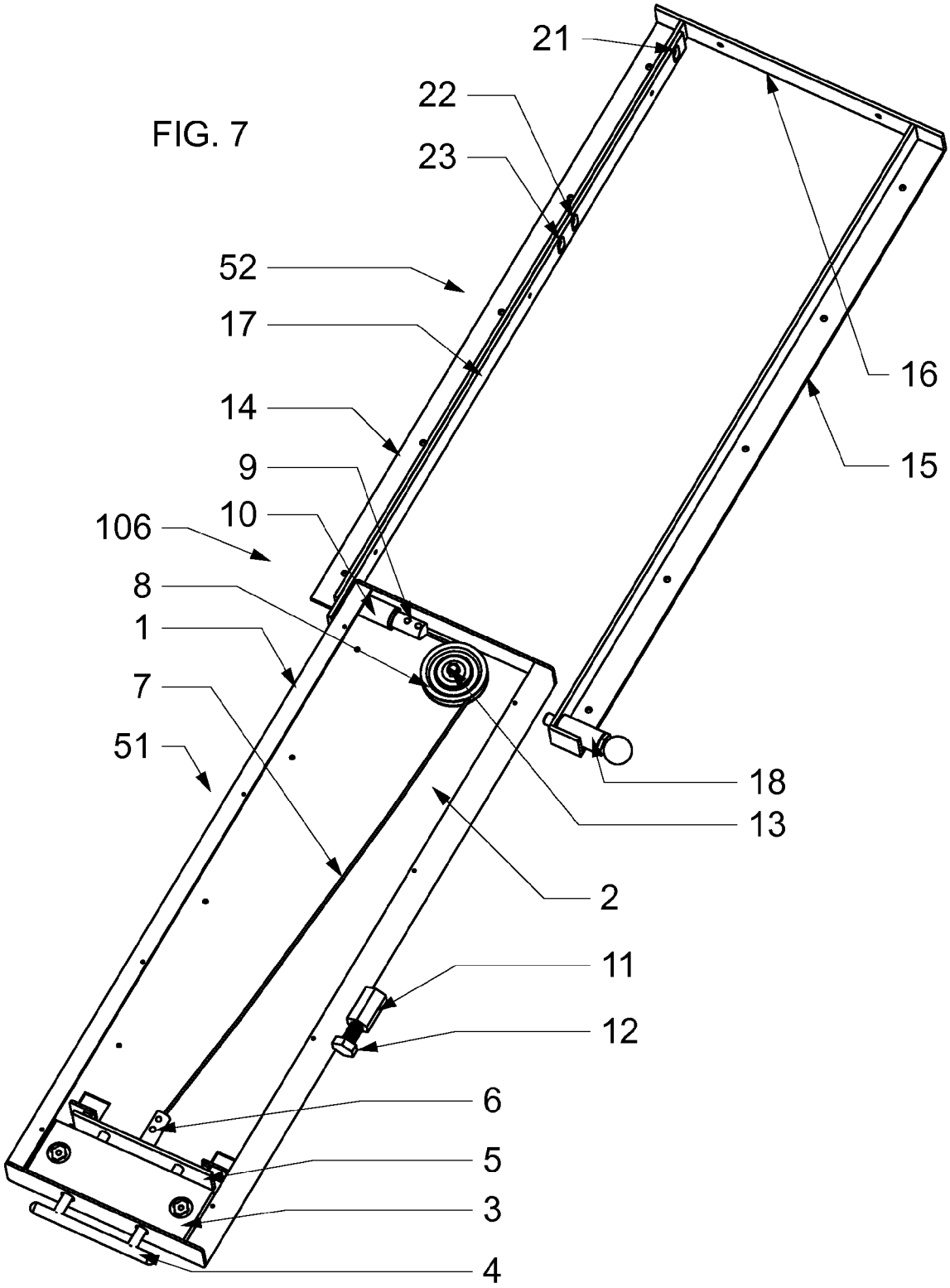
FIG. 7 is a top down, see-through view of the MPRLM so interior parts are visible.

FIG. 7 illustrates the components of the MPRLM in the preferred embodiment, which consists of two dedicated modules, the Upper Latch Housing (ULH) 51 and the U-Shaped Track (UST) 52. The ULH 51 is securely mounted to the seat cushion-mounting panel of cassette 102 and moves in and out with the seat cushion. The UST 52 is securely mounted to the base cabinet 101 and stays in a fixed position, relative to the base, while the ULH moves in and out horizontally.

The ULH 51 includes an enclosure 1, fabricated with a full top, from which all four sides are bent down. The ULH 51 includes two flanges returning inward one from each of the left and the right sides for fastening of the inspection plate 2. With the inspection plate 2 fastened to the enclosure 1, a closed box is formed. One of ordinary skill in the art would see that other embodiments are possible such as placing the inspection plate on top of the box or having the enclosure 1 opened depending needs of the implementation. A block of Ultra High Molecular Weight Polyethylene (UHMW) handle guide block 3, that provides support to the handle 4 is fastened to the enclosure using flathead bolts and recessed T-nuts. The handle guide block 3 is self-lubricated and provides quiet, smooth operation with low maintenance. Other embodiments are contemplated using other materials for the guide block or metal sleeves when the self-lubrication is not needed. The handle 4 has two extended legs, which extend through the UHMW guide block and are fastened to a handle crossbar 5, to which a cable adapter 6 is fastened. The cable adapter has two setscrews used to attach it to a ⅛" aircraft cable 7. The attached cable loops around pulley 8 to a second adapter 9, which screws into the back of a spring-loaded bolt 10. The ball bearing pulley 8 mounts to the enclosure 1 with an elevator bolt 13 and nylon lock nut. The two setscrews are used to install cable 7, and are adjustable so there is a slight tension to keep the cable in place. Pulling on the handle 4 remotely actuates the spring-loaded bolt 10 causing the bolt to retract. The right side of the enclosure 1 has a threaded coupler 11, and which holds the adjustable stop bolt 12, which limits the range of movement of the ULH and thus also the seat cushion.

The UST 52 is preferably fabricated out of 1½"×3/16" angle on the left side 14 and the right side 15. The side angles are connected using a 1½"×3/16" flat bar 16, the three pieces providing a framework that is fastened to the base cabinet 101. The left side angle 14 has three horizontal slots machined in a front, center and rear position (not shown). The slots allow attachment of the latch point flat bar 17, with bolts in a manner that allows adjustment front to back of the latch point flat bar 17. In the preferred embodiment the Flat bar is machined with three holes at 21, 22 and 23, large enough to receive the bolt of the spring-loaded bolt and hold it in position. These holes 21, 22, and 23 are elongated ovals to allow the bolt to enter the holes even with a possible small vertical variance in the relationship between the bolt 10 and latch plate bar 17. The Left side angle 14 has three round oversize reliefs at points corresponding to holes 21-23 on the latch point flat bar 17 for the bolt end of the spring-loaded bolts to pass through both the latch point flat bar 14 and the left side angle 14 without interference from the left side angle 14. The UST 52 and particularly the latch point flat bar provide a frame to hold the ULH 51 and its remotely actuated spring-loaded bolt in position. The front edge of the latch point flat bar 17 has a slight radius top and bottom to allow the spring-loaded bolt 10 from the ULH 51 to engage in front of the latch point bar 17 latching the seat assembly in the fully extended service position. The right side angle 15 is slightly longer than the left side angle to provide strategic placement of the secondary spring-loaded bolt 18 at the extreme front. This secondary spring-loaded bolt 18 is also the mechanical stop that the ULH 51 adjustable stop bolt 12 engages at the bed position. The secondary spring-loaded bolt 18 and the adjustable stop bolt 12 work together to limit the range of movement of the ULH 51, between the seat position and the bed position thus also limiting the movement of the seat cushion to that range. Further by actuating the secondary spring-loaded bolt 18 to retract the bolt the range of movement of the ULH is extended to include the service position.

Figure 8:
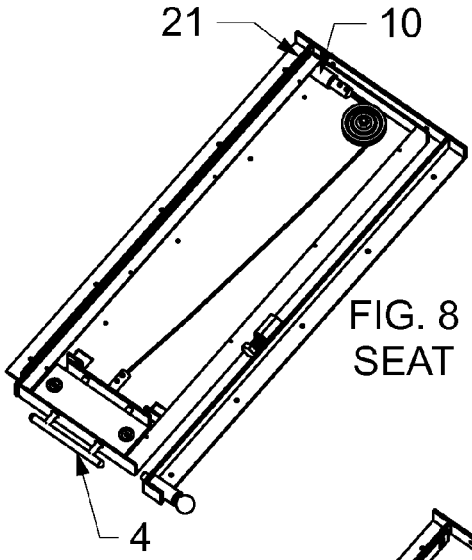
FIG. 8 is the MPRLM aligned in the closed or seat position.

FIGS. 8 through 11 show the operation of the MPRLM 106 in the preferred embodiment of the invention to position the patient room window seat as shown in FIGS. 3-6. FIG. 8 shows the configuration of the MPRLM 106 with the patient room window seat in the seat position with a portion of the cushion 105 under the backrest cabinet 103 as shown in FIG. 3. The spring-loaded bolt 10 is in the extended position passing through hole 21 in the UST securely latching the moveable parts in the seat position.

When it is desirable to extend the seat cushion to the bed position the user places his thumb against the cushion to hold it in place while pulling handle 4. The pulling force smoothly and easily actuates the spring-loaded bolt 10, retracting the bolt so the bolt clears the latch point bar 17 at which point the user pulls forward and the cushion 105 and its support framework slides forward until the stop bolt 12 contacts the secondary spring-loaded bolt 18. At this point, the seat has reached the bed position as shown in FIG. 5 the full mattress being out from under the backrest 103-104. Releasing the handle allows the spring tension on the spring-loaded bolt 10, to engage the bolt, causing the bolt end of the spring-loaded bolt to enter hole 23 and latch the seat in the bed position as shown in FIG. 5, with the cushion fully exposed to form a mattress for sleeping.

Figure 9:
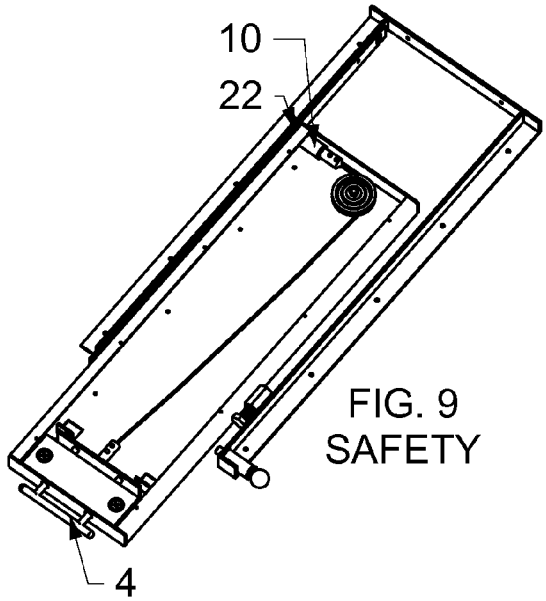
FIG. 9 is the MPRLM aligned in the Safety position.
Figure 10:
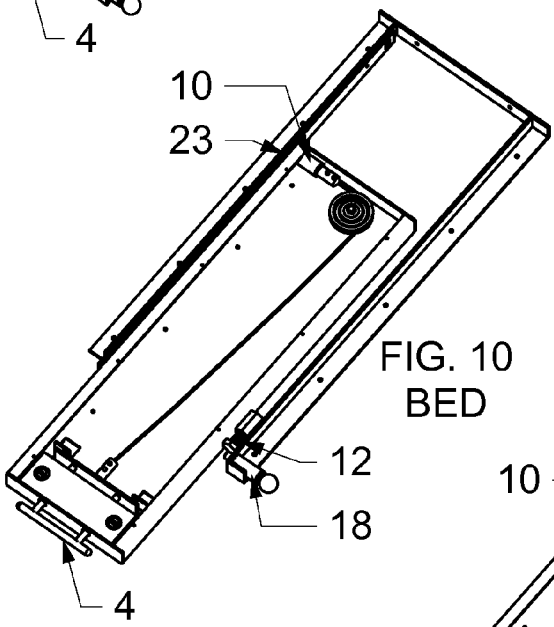
FIG. 10 is the MPRLM aligned in the bed position.
Figure 11:
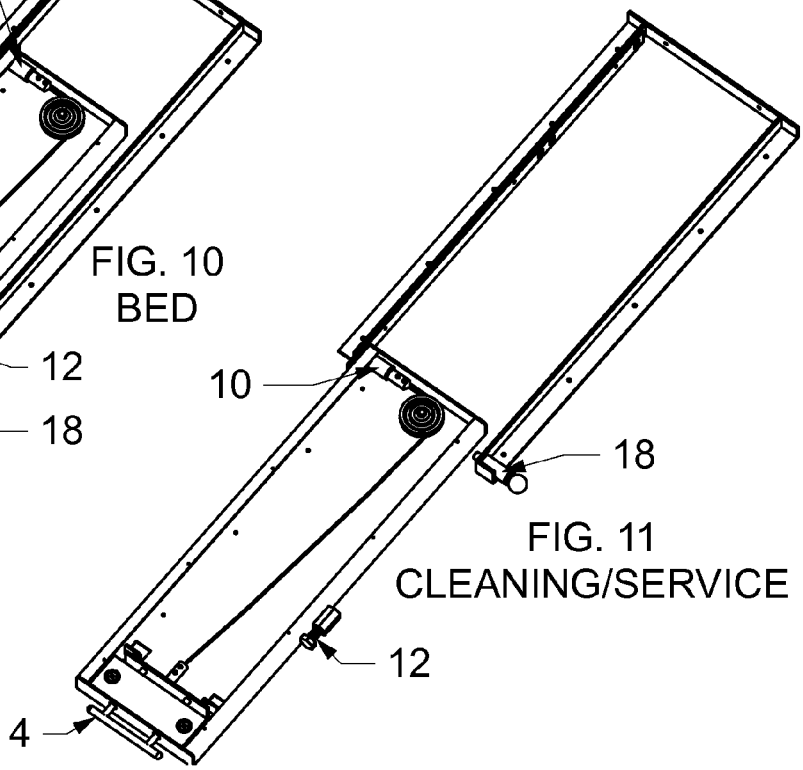
FIG. 11 is the MPRLM aligned in the service position.

If for any reason spring-loaded bolt 10 is not engaged in hole 23 and thus not latched when the handle 4 is released, the seat would move between positions easily. A person leaning against the extended seat cushion would cause it to retract without warning. Because this may cause a fall, especially if the person leaning is elderly or infirm a safety hole 22 was placed in the UST. This hole is a short distance to the rear of hole 23 so that the bolt on passing that hole 22 without the handle 4 being pulled would engage the hole by extending into it and stop the seat retraction, as shown in FIG. 9, before any harm could be done. FIG. 4 shows the seat in the safety position.

FIG. 6 shows the service position that allows full access under the seat and support frame 109. Full access is not provided in the positions shown in FIGS. 3-5 and is necessary for cleaning and maintenance of the patient window seat. To put the seat in the service position, if not already in the bed position, the cushion is moved to the bed position as discussed hereinabove. While in the bed position the handle 4 is pulled to actuate the spring-loaded bolt 10 and retract the spring-loaded bolt from hole 23. While maintaining spring-loaded bolt 10 actuated, pull grip on the secondary spring-loaded bolt to actuate the secondary spring-loaded bolt 18. Retracting the secondary spring-loaded bolt 18 and allows the ULH 51 and the seat to continue forward. Pulling the cushion forward when the adjustable stop bolt 12 and threaded coupler move past the secondary spring-loaded bolt the secondary spring-loaded bolt can be released and the cushion assembly can be pulled out to the position shown in FIGS. 6 and 10. That position is at the end of the range of movement allowed by the slides 107. Handle 4 is released allowing the bolt 10 to extend in front of the latch point flat bar 17 thus latching the seat in the service position. The service position allows full access to the base cabinet 101 and cassette 102 to cleaning and maintenance personnel. Kneeling on or sitting on the cushion is safe when in the service position as the cassette is securely latched in position and the slides and other components of the bench seat will support the weight.

The spring-loaded bolts 10 and 18 are commercially available and designed for use on weight equipment. Other components such as the adapters, ball bearing pulley, and the handle are also commercially available. While other components such as most notably the enclosure 1 that is laser cut and machine shaped for greater precision.

Other embodiments of the remotely actuated bolt are also apparent, instead of ⅛ inch aircraft cable and pulley, a bicycle cable could be used, with a corresponding change in hardware. In addition, the cable could be replaced completely with a remote control electrical solenoid. The electrical solenoid would be controlled by an electrical switch instead of the handle 4. A master switch or a computer control could be set in a central location such a nurses station to prevent the solenoid from being actuated unless permission was granted to convert to the bed position. Similarly, the secondary spring-loaded bolt 18 could be actuated by an electrical solenoid and actuated with a keyed switch with key given to the cleaning staff and the maintenance staff. If the secondary spring-loaded bolt is also put on an electrical solenoid, it could be moved to the inside of the enclosure of the ULH 51 and the adjustable stop bolt 12 to the UST 52. Also in some configurations, it may be advantageous to attach the ULH 51 to the fixed element of the embodiment and the UST 52 to the movable element.

In addition to the current embodiment for hospital use as a patient window seat, the latch mechanism could be used in applications in other medical environments, dental environment, marine environments, military equipment recreational vehicles, and automotive applications. The MPRLM may be used on numerous items that need to be easily moved between multiple positions and positively latched in one or more the positions. Other embodiments could be used on slide out shelves, steps that slide out possibly on recreational or military vehicles, tabletops that extend such as changing tables, or any type of slide out storage. These variations may involve changing the orientation of the MPRLM and or changing the size of some or all of the components as need by the implementation.

While embodiments of the invention have been illustrated and described in the drawings and the description contained hereinabove, the description and the illustrations are to be considered illustrative in nature and not restrictive. The embodiments shown and described in this specification are for satisfaction of the best mode and enablement requirements. One of ordinary skill in the art could make numerous adaptations and changes such as those briefly discussed above, and it would be impractical to attempt to describe all such variations to the embodiments in the present specification. Thus, it is to be understood that protection is sought for all changes that come within the spirit of the invention as set forth by the claims.

We claim:

1. A modular remote latch unit capable of remotely latching in one of multiple positions comprising:

a remote latching means for actuating the modular remote latch unit by remotely retracting and extending a first spring loaded bolt, the remote latching means attached to a movable component;

a position holding means for receiving the first spring loaded bolt to engage the position holding means in a plurality of positions, the position holding means attached to a stationary component; and the modular remote latch unit latches said movable component to hold the movable component fixed in the first position relative to the stationary component when the first spring loaded bolt of said remote latching means is extended and allowing movement when the first spring loaded bolt is retracted.

2. The modular remote latch unit of claim 1 is used in conjunction with a sliding means attached to said movable component to provide support and low friction movement of the movable component and said modular remote latch unit is operable to latch said movable component, latching the movable component maintains its position fixed in a plurality of positions relative to said stationary component.

3. Where the sliding means of claim 2 comprises, ball bearing full extension slides rated to support the moveable component and its load.

4. The modular remote latch unit of claim 1 further comprising:

a limiting means for limiting the movement of the movable component allowed by retracting said first spring loaded bolt to a predetermined range of movement;

a latching means for actuating a second spring loaded bolt to retract the second spring loaded bolt and extend the second spring loaded bolt; and retracting the second spring loaded bolt permits the moving component to move farther than the predetermined range of movement allowed by said limiting means such that the range of movement is extended to a second range of movement distinct from the first range of movement.

5. The modular remote latch unit of claim 4 where said fixed component comprises a furniture base and said movable component comprises a movable cushion unit which moves between and is latched in a bed position and a seat position and said second range of movement extends the movable cushion unit to a service position that provides full access.

6. The modular remote latch unit of claim 1 where said remote latching means comprises a handle connected to the first spring loaded bolt by means of a cable using mechanical force to activate the first spring loaded bolt.

7. The modular remote latch unit of claim 1 where said remote latching means comprises a electrical switch connected to the first spring loaded bolt by means of electrical wires and an electrical solenoid using electromotive force to actuate the first spring loaded bolt.

8. The modular remote latch unit of claim 7, further comprising a controller means at a remote location that controls the electrical solenoid to allow the switch to operate the solenoid and to block operation of the solenoid as directed.

9. The modular latch unit of claim 5 further comprising at least one safety latch position between the bed position and the seat position the at least one safety latch position limiting unintentional movement between the bed position and the seat position.

10. A modular remote latching unit comprising:

a first module comprising:

a remotely actuated spring loaded bolt;

a manipulator mounted remotely from said spring loaded bolt;

a linkage remotely connecting the manipulator and the remotely actuated spring loaded bolt, the remotely actuated spring loaded bolt being remotely actuated by the linkage; and an enclosure the enclosure securely mounted to a movable subassembly the movable subassembly being external to the modular remote latching mechanism, the remotely actuated spring loaded bolt being mounted inside the enclosure such that a bolt portion of the spring loaded bolt extends from the enclosure when extended and retracts substantially into the enclosure when actuated, the linkage passes inside the enclosure, and the manipulator is attached to the enclosure; and a second module comprising;

a position holding part, which receives an extended portion of the remotely actuated spring loaded bolt, the position holding part and the spring loaded bolt working together securely latch the movable subassembly in one or more selected positions; and a frame, the frame securely mounted to a fixed subassembly the fixed subassembly being external to the modular remote latching mechanism, the frame also supporting the position holding part, the position of the position holding part being adjustable.

11. The modular remote latch unit of claim 10 further comprising a ball bearing full extension slides attached to said movable subassembly to provide support and low friction movement of the movable subassembly.

12. The modular remote latch unit of claim 10 wherein the manipulator is a handle and the linkage is a cable connected to the spring loaded bolt through an adaptor.

13. A modular remote latching unit comprising:

a first module comprising:

a first remotely actuated spring loaded bolt the remote actuation of the spring loaded bolt causing the remotely actuated spring loaded bolt to retract and extend;

a manipulator mounted remotely from said spring loaded bolt;

a linkage remotely connecting the manipulator and first remotely actuated spring loaded bolt, the first remotely actuated spring loaded bolt being remotely actuated by the linkage;

an enclosure the enclosure securely mounted to a movable subassembly the movable subassembly being external to the modular remote latching mechanism;

a second module comprising;

a position holding part which receives an extended portion of the first remotely actuated spring loaded bolt, the position holding part and the spring loaded bolt working together securely latch the movable subassembly in one or more selected positions;

a frame, the frame securely mounted to a fixed subassembly the fixed subassembly being external to the modular remote latching mechanism, the frame also supporting the position holding part; and a first stop component attached securely to the frame of the second module interacting with a second stop component on the enclosure of the first module so that when the first stop component in combination with the second stop component limits the movable assembly to a first range of movement, one of the first and second stop components being movable to allow a second range of movement, the second range of movement distinct from the first range of movement.

14. The modular remote latch unit of claim 13 wherein the manipulator comprises an electrical solenoid physically connected to the remotely actuated spring loaded bolt controlled by an electrical switch.

15. The modular remote latch unit of claim 14 further comprising a control unit remote from the modular remote latch unit, which controls the signal between the switch and the solenoid to override operation of the electrical switch.

16. The modular remote latch unit of claim 13 wherein a first stop component is a second spring loaded bolt when the second spring loaded bolt is extended movement is limited to the first range of movement and when the second spring loaded bolt is retracted the range of movement is extended to the second range of movement.

17. The modular remote latch unit of claim 13 wherein a second stop component is a second spring loaded bolt when the second spring loaded bolt is extended movement is limited to the first range of movement and when the second spring loaded bolt is retracted the range of movement is extended to the second range of movement.

18. The modular remote latch unit of claim 13 where the fixed subassembly comprises a furniture base and the movable subassembly comprises a movable cushion unit which moves between and is latched in a bed position and a seat position and said second range of movement extends to a service position that provides full access.

19. The modular remote latch unit of claim 18 further comprising at least one safety latch position between the bed latch position and the seat latch position the at least one safety latch position limiting unintentional movement or between the bed position and the seat position.

20. A method for converting a patient room window seat between to seat bed and service positions, the method comprising:

With the patient room window seat in a seat position, gently pull a handle horizontally forward from at rest position of the handle under a seat cushion in front of the seat until a remotely actuated spring loaded bolt releases;

continue to pull the handle forward with one hand as the seat cushion comes out from under a backrest assembly, when the seat cushion is out from under the backrest assembly a stop bolt is contacted and the cushion stops moving forward, the cushion has reached a bed position and releasing the handle latches the cushion in the bed position;

continue to the service position by gently pulling the handle forward again to release the remote actuated spring loaded bolt, reach a direct release spring loaded bolt that is a stop bolt and pull the direct release spring loaded bolt to the side to release the stop bolt;

pulling on the handle will now bring the cushion forward and when it has moved a short distance the stop bolt may be released, continue pulling the cushion forward until it stops again at the service position releasing the handle causes the remotely actuated spring loaded bolt to engage.

* * * * *